United States Patent [19]

Bringe

[11] 4,149,443

[45] Apr. 17, 1979

[54] STRINGED INSTRUMENT CAPO

[76] Inventor: John E. Bringe, 333 Downs Rd., Bethany, Conn. 06525

[21] Appl. No.: 774,916

[22] Filed: Mar. 7, 1977

[51] Int. Cl.[2] ..... G10D 3/04

[52] U.S. Cl. ..... 84/318

[58] Field of Search ..... 84/315, 316, 317, 318; 248/226.2, 316 B, 74 R, 63, 316 E; 63/14 C; 24/250 R; 269/196-200, 236

[56] References Cited

U.S. PATENT DOCUMENTS

| | | | |
|---|---|---|---|
| 390,612 | 10/1888 | Moffat | 84/318 |
| 452,639 | 5/1891 | Gatchell | 269/236 |
| 3,020,734 | 2/1962 | Withers | 63/14 C |
| 4,048,894 | 9/1977 | Myerson et al. | 84/318 |

*Primary Examiner*—L. T. Hix
*Assistant Examiner*—Benjamin R. Fuller
*Attorney, Agent, or Firm*—McCormick, Paulding & Huber

[57] ABSTRACT

A capo for a guitar, banjo or similar stringed instrument includes a body providing an arm for engaging the instrument's strings and a clamp mechanism operable by one hand to move the cap into and out of clamped relationship with the instrument's neck. Further the capo may be moved from one position to another along an instrument's neck or may be entirely removed from or replaced on the instrument with one hand and without the instrument having to be shifted from its normal playing position during a performance.

4 Claims, 5 Drawing Figures

STRINGED INSTRUMENT CAPO

BACKGROUND OF THE INVENTION

This invention relates to a capo for use with a stringed musical instrument, such as a guitar or banjo, having a neck and a set of strings extending along the length of the neck, the capo serving to hold the strings against the fingerboard surface of the neck to make the strings of shorter than normal open length. More particularly, the invention relates to a capo which is an improvement over previous capo designs especially with regard to the case with which it may be attached to or removed from an instrument neck or moved from one position to another along the neck.

When a capo is in use on an instrument neck, it is desirable that its string engaging portion securely and tightly press the strings against the surface of the fingerboard regardless of whether or not the fingerboard includes frets. This requires that the capo be clamped to the neck with a considerable clamping force, and in previous capo constructions this force has been obtained through the use of relatively cumbersome clamping utilizing screws, toggle levers, springs, elastic bands etc. which were difficult to handle or time consuming to manipulate. In particular, the constructions of previous capos have generally been such that the acts of attaching one to an istrument neck, removing it from the neck or shifting it from one position to a another along the neck have required the use of two hands and have further required the performer to shift the instrument from its normal playing position.

The general object of this invention is, therfore, to provide an improved capo which includes a simple rapid application and rapid release clamping mechanism allowing it to be rapidly applied, released or shifted relative to an instrument neck by a simple one-handed manual operation without moving the instrument from its normal playing position thereby allowing the capo to be quickly applied, released or shifted, and enabling such changes to be made during a performance, if need be, without substantial interruption of the performance.

A further object of this invention is to provide a capo of the foregoing character which is of a rugged construction and which when operatively in place serves to hold the strings tightly against the fingerboard surface.

A still further object of this invention is to provide a capo of the foregoing character which is capable of being clamped to neck sections of a wide range of different sizes thereby permitting it be used with various different sized necks and/or with a single neck having a cross section which varies substantially in sized in going from one end to the other.

Other objects and advantages of the invention will be apparent from the following description and from the drawings forming a part hereof.

SUMMARY OF THE INVENTION

The invention resides n a stringed instrument capo having a body providing a top or string engaging arm adapted to extend transversely across the strings and the fingerboard surface of the neck of the instrument with which it is used. A side arm is integrally connected with one end of the top arm and extends rearwardly therefrom. A clamping jaw, pivotally connected to the side arm, extends from its pivot axis generally parallel to the top arm and is movable about its pivot axis into and out of engagement with the rear surface of an instrument neck received between it and the tip arm. The clamping jaw is movable by an operating lever also pivotally connected to the side arm through coengageable cam areas on the jaw and lever, the cam area of the lever comprising a plurality of rise and dwell surfaces arranged as a stair with the result that as the operating lever is moved in one direction about its pivot axis the clamping jaw is moved in step-wise fashion toward clamping engagement with the rear surface of the instrument neck and with the result that when the desired clamping relationship is reached the jaw and lever hold their last positions until released by further manual operation of the lever.

DETAILED DESCRIPTION OF THE PREFERRED EMBODIMENTS

Figure 1:
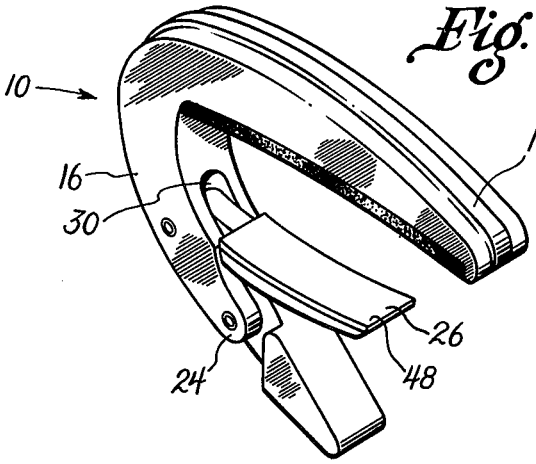
FIG. 1 is a perspective view of a capo embodying this invention.
Figure 2:
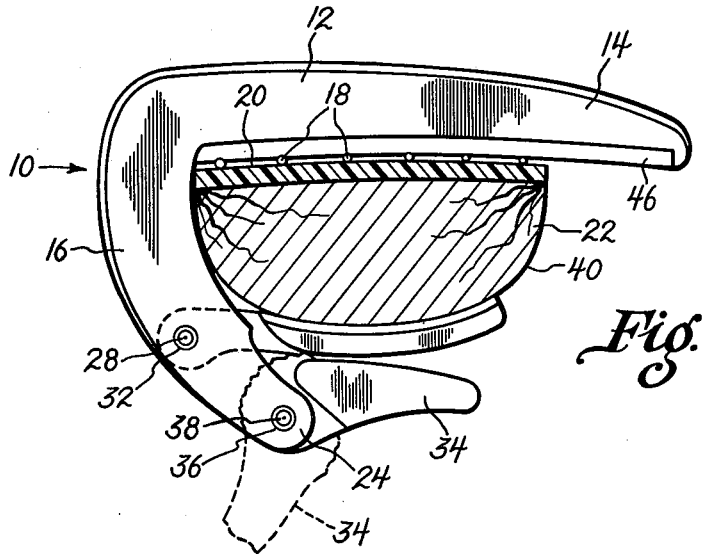
FIG. 2 is a side elevational view of the capo of FIG. 1 showing it attached to a neck at a point where the neck has substantially the minimum cross sectional size with which the capo may be used.
Figure 3:
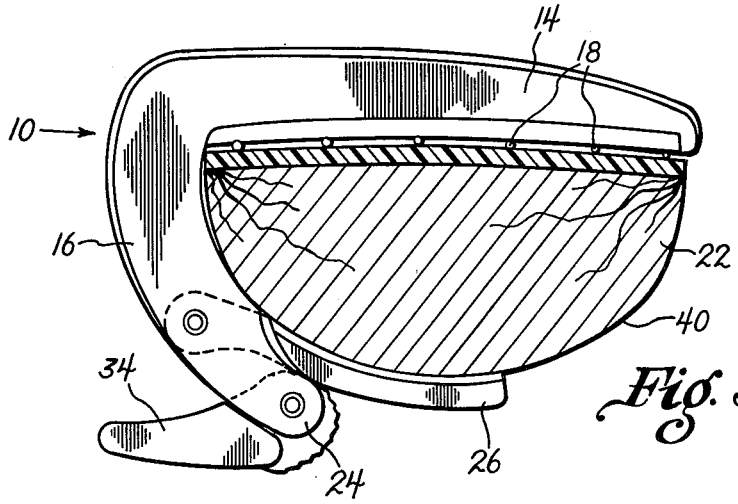
FIG. 3 is a view similar to FIG. 2 but shows the capo attached to a neck at a point where it has a cross sectional size substantially equal to the maximum with which the capo may be used.
Figure 4:
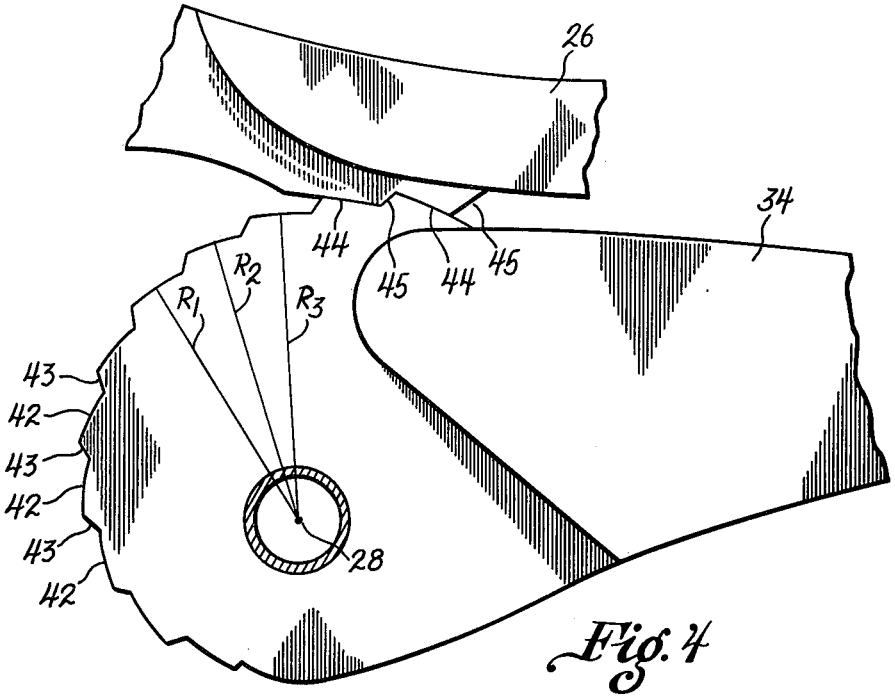
FIG. 4 is an enlarged fragmentary view showing the cam areas of the jaw and of the operating lever of the capo of FIG. 1.

Referring to FIGS. 1 to 4, a capo embodying the invention is shown generally at 10. It includes a one-piece body 12 shaped somewhat like the letter "C" and having a top arm 14 and a side arm 16. As shown in FIGS. 2 and 3, the top arm 14 is intended to extend across the strings 18, 18 and the fingerboard surface 20 of the instrument neck 22 with which the capo is used. The arm 14 has one free end and the side arm 16 is integrally connected to it at its opposite end. The side arm 16, n turn, extends rearwardly from the top arm 14 and in doing so curves inwardly towards the free end of the top arm so as to terminate in a free end 24 located rearwardly of the top arm and between its two ends.

A clamping jaw 26 is pivotally connected to the side arm 16 for pivotal movement relative to the side arm about a first pivot axis 28. To make this connection, the side arm 16 is divided into two spaced cheeks by a slot 30 which receives an ear portion of the jaw, and a roll pin 32 is inserted through the side arm cheeks and through the ear of the jaw.

Also carried by the side arm 16 is an operating lever 34 pivotally connected to the side arm by another roll pin 36 inserted through the side arm cheeks and a portion of the operating lever received in the slot 30. The pivot axis of the operating lever relative to the side arm is indicated at 38 and is located between the pivot axis 28 and the free end 24 of the side arm.

The clamping jaw 26 extends from its pivot axis 28 in a generally parallel relationship to the top arm 14 and is therefore, as a result of pivotal movement about its axis 28, movable toward and away from the rear surface 40 of the neck 22 positioned between it and the top arm. Such movement of the jaw 26 is effected by movement of the operating lever 34 through coengaging cam areas on the jaw and lever. As shown best in FIG. 4, the cam area of the lever 34 is comprised of a plurality of dwell surfaces 42, 42 which alternate with a plurality of rise surfaces 43, 43 so that the dwell and rise surfaces are arranged in a stair fashion. That is, in going from one circumferential end to the other circumferential end of the lever's cam area, the dwell surfaces 42, 42 are at progressively larger or smaller (depending on the direction of movement) radial levels from the pivot axis 28. For example, of the three radiuses shown in FIG. 4 $R_1<R_2<R_3$.

The dwell surfaces 42, 42 and rise surfaces 43, 43 of the lever 34 cooperate with two rest surfaces 44, 44 and two cam surfaces 45, 45 on the jaw 26. From FIGS. 2 and 4, it will therefore be evident that as the lever 34 is moved clockwise from its illustrated full line position toward the illustrated broken line position, the jaw 26 will be allowed to move clockwise to bring it out of clamping relationship with the instrument neck. On the other hand, when the operating lever 34 is in the broken line position of FIG. 2 and then moved counterclockwise toward the full line position, the surfaces 42, 42 and 43, 43 will cause the jaw 26 to be moved in stepwise fashion toward the rear surface 40 of the instrument neck and into eventual clamping relationship with it. That is, as the rise surfaces 43, 43 of the lever engage and move over the cam surfaces 45, 45 of the jaw, the jaw will be cammed incrementally toward the neck, and as the dwell surfaces 42, 42 move over the rest surfaces 44, 44 the jaw 26 will momentarily retain its present position. The dwell surfaces 42, 42 are slightly curved and have their centers of curvature substantially coincident with the pivot axis 28. Therefore, when the rest surfaces 44, 44 engage a pair of dwell surfaces 42, 42 the lines of action of the forces imposed by the rest surfaces on the operating lever pass through the pivot axis 28 and produce no torque on the operating lever. When manual movement of the operating lever in the clamping direction is stopped, this causes the lever to hold its last position. That is, after the clamping jaw has reached clamping relationship with the neck, it will be held there by the lever until it is released by the lever being manually moved in the releasing or clockwise direction.

As shown by comparison of FIG. 2 with FIG. 3, the arrangement of the cam areas of the operating lever and jaw, and the arrangement of other parts, allows the capo to be used with neck cross sections of various different sizes, FIG. 2 showing the capo in clamped engagement with a small section neck and FIG. 3 showing it in clamped engagement with a large neck section.

Preferably, and as shown, the top arm 14 includes a resilient pad 46 of rubber or the like for engaging the strings 18, 18 and likewise the clamping jaw 26 includes a resilient pad 48 of rubber or the like for engaging the rear surface of the neck. The remaining parts of the capo may be made of various suitable materials. In particular, the body 16, jaw 26 and lever 34 may be made of metal or plastic, a preferred material for all three of these parts being powdered stainless steel.

The dwell and rise surfaces of the cam area of the operating lever and the rest and cam surfaces of the jaw may take various different shapes without departing from the broader aspects of the invention. Also, the number of rest and cam surfaces on the jaw may vary. As a limit, only one rest surface and one cam surface may suffice, and these may blend with one another and be provided by a simple bump or protrusion on the jaw. In any event, however, the shape and arrangement of the dwell surfaces should always be such that the line of action of a force imposed on the lever by the jaw will either pass substantially through the lever's pivot axis 28 or to such side of such pivot axis that the torque exerted on the operating lever urges it in the counterclockwise direction.

Figure 5:
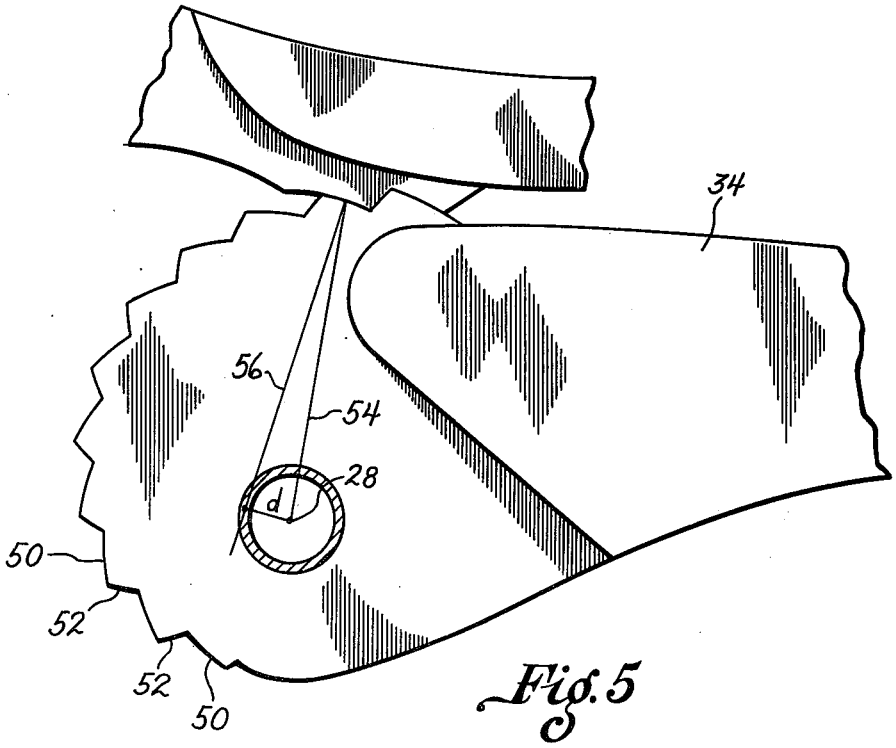
FIG. 5 is a view similar to FIG. 4 but shows an alternative embodiment of the invention.

By way of example, FIG. 5 shows a lever 34 with an alternative form of dwell surfaces. Referring to this figure, the cam area of the illustrated operating lever 34 includes dwell surfaces 50, 50 and rise surfaces 52, 52. Each dwell surface 50 is curved and has its center of curvature displaced slightly from the line 54 passing through the pivot axis. Therefore, the line of action 56 has a moment arm d with respect to the pivot axis, producing a torque tending to rotate the lever 34 in the counterclockwise direction in FIG. 5 and thereby causing the lever to hold the illustrated position until moved from it by a manually applied force.

I claim:

1. In a capo for use with a guitar or similar stringed instrument having a neck with a front fingerboard surface and a curved rear surface and having a plurality of strings extending longitudinally of said neck over said fingerboard surface, said capo comprising a body having a top arm adapted to extend transversely across the strings and the fingerboard surface of the neck of an instrument, said top arm having a first free end and a second end opposite said free end, said body also having a side arm fixed to said top arm at said second end of said top arm and extending rearwardly from said top arm and toward said first end of said top arm so as to terminate in a free end located rearwardly of said top arm and transversely between said first and second ends of said top arm, a jaw connected to said side arm for pivotal movement relative to said side arm about a first pivot axis, said jaw extending from said first pivot axis toward said first end of said top arm in generally parallel relationship to said top arm and being movable into and out of engagement with the rear surface of an instrument neck received between said top arm and jaw as a result of its pivotal movement relative to said side arm about said first pivot axis, and an operating lever connected to said side arm for pivotal movement relative to said side arm about a second pivot axis parallel to said first pivot axis, said operating lever and said jaw having coengageable cam areas for moving said jaw into clamping relationship with an instrument neck positioned between said top arm and said jaw in response to manual movement of said operating lever in a first direction about said second pivot axis and for freeing said jaw from said clamping relationship in response to manual movement of said operating lever in the opposite direction about said second pivot axis, the improvement comprising said cam area of said operating lever extending a substantial angular extent about said second pivot axis and being comprised of a plurality of discrete dwell and rise surfaces, said dwell surfaces alternating with said rise surfaces, and said dwell surfaces being located at progressively increasing distances from said second pivot axis in going along said cam area of said lever in said opposite direction about said second pivot axis, said rise surfaces of said operating lever each extending from one to the next of said dwell surfaces and being inclined to a radial line from said second pivot axis so as to face generally outwardly from and in said first direction relative to said second pivot axis, said cam area of said jaw including at least one discrete rest surface and at least one discrete cam surface, said at least one rest surface of said jaw being generally parallel to that dwell surface of said operating lever located at the point of contact between said operating lever and said jaw and said at least one cam surface of said jaw being generally parallel to that rise surface of said operating lever located at the point of contact between said operating lever and said jaw, said dwell surfaces of said operating lever further each being arranged relative to said second pivot axis that the force imposed thereon by said at least one rest surface of said jaw, when an instrument neck is clamped between said top arm and said jaw, will not tend to rotate said lever in said opposite direction about said second pivot axis, whereby said jaw is moved toward said neck in a step-wise fashion upon manual movement of said operating lever in said first direction and said jaw and said lever are caused to hold whatever positions they have when said jaw reaches said clamping relationship until said lever is subsequently manually moved in said opposite direction.

2. A capo as defined in claimed 1 further characterized by said body being a one-piece member wherein said top arm and side arm are integral with one another.

3. A capo as defined in claim 1 further characterized by each of said dwell surfaces of said operating lever having such a shape and being so arranged that the line of action of a force imposed thereon by said at least one rest surface of said jaw, when an instrument neck is clamped between said top arm and said jaw with such dwell surface in engagement with said rest surface, substantially intersects said second pivot axis and therefore causes said force to exert substantially no torque on said operating lever.

4. A capo as defined in claim 1 further characterized by each of said dwell surfaces of said operating lever having such a shape and being so arranged that the line of action of a force imposed thereon by said at least one rest surface of said jaw, when an instrument neck is clamped between said top arm and said jaw with such dwell surface in engagement with said rest surface, does not intersect said second pivot axis and is spaced therefrom in such direction that the torque exerted on said lever by said force tends to rotate said lever in said first direction and to bring said at least one cam surface of said jaw into engagement with a corresponding one of said rise surfaces of said operating lever.

* * * * *